US011027539B2

(12) United States Patent
Edwards

(10) Patent No.: US 11,027,539 B2
(45) Date of Patent: Jun. 8, 2021

(54) PRINTING PALLET FOR ARTICLES OF CLOTHING

(71) Applicant: Jacob Edwards, Willoughby, OH (US)

(72) Inventor: Jacob Edwards, Willoughby, OH (US)

(73) Assignee: JAKPRINTS, INC., Cleveland, OH (US)

( * ) Notice: Subject to any disclaimer, the term of this patent is extended or adjusted under 35 U.S.C. 154(b) by 37 days.

(21) Appl. No.: 15/981,644

(22) Filed: May 16, 2018

(65) Prior Publication Data

US 2018/0333949 A1 Nov. 22, 2018

Related U.S. Application Data

(60) Provisional application No. 62/506,686, filed on May 16, 2017.

(51) Int. Cl.

| | |
|---|---|
| ***B41F 17/00*** | (2006.01) |
| ***B41F 16/02*** | (2006.01) |
| ***B41F 15/18*** | (2006.01) |
| ***D06P 5/00*** | (2006.01) |

(52) U.S. Cl.

CPC ..... *B41F 17/005* (2013.01); *B41F 15/18* (2013.01); *B41F 16/02* (2013.01); *D06P 5/00* (2013.01)

(58) Field of Classification Search

CPC .. B41F 15/08; B41F 15/0818; B41F 15/0863; B41F 15/10; B41F 15/16; B41F 15/18; B41F 15/26; B41F 16/02; B41F 17/00; B41F 17/005; B41F 17/38; B41F 27/005; B41J 3/4078; B41M 1/26; B41P 2215/00; B41P 2215/11; B41P 2215/50; B41P 2215/112; B41P 2215/114

See application file for complete search history.

(56) References Cited

U.S. PATENT DOCUMENTS

| | | | | |
|---|---|---|---|---|
| 283,810 | A * | 8/1883 | Perkins | D06F 71/22 38/110 |
| 409,684 | A * | 8/1889 | Jackson | D06F 71/22 38/109 |
| 4,909,146 | A * | 3/1990 | Szarka | B41F 15/0863 101/126 |
| 5,161,466 | A * | 11/1992 | Burris | B41F 15/18 101/126 |
| 5,188,034 | A | 2/1993 | Iaccino et al. | |
| 6,067,737 | A * | 5/2000 | Guenther | D05C 9/04 112/103 |
| 6,640,714 | B1 | 11/2003 | Papa | |
| 7,413,301 | B2 * | 8/2008 | Niimi | B41J 2/01 101/126 |
| 8,807,031 | B2 * | 8/2014 | Styles | B41J 3/4073 101/126 |
| 9,302,462 | B2 | 4/2016 | Livingston | |

(Continued)

*Primary Examiner* — Matthew G Marini
*Assistant Examiner* — Marissa Ferguson-Samreth
(74) *Attorney, Agent, or Firm* — Fay Sharpe LLP

(57) ABSTRACT

Disclosed is a pallet for printing on an article of clothing. The pallet includes a mount plate including a first end and a second end and a top plate including a first end and a second end. The second end of the top plate located at the second end of the mount plate. A gap is between the top plate and the mount plate. A collar plate is located on the first end of the mount plate. The first end of the mount plate extends beyond the first end of the top plate to define a space between the top plate and the collar plate.

17 Claims, 10 Drawing Sheets

(56) References Cited

U.S. PATENT DOCUMENTS

| | | | | |
|---|---|---|---|---|
| 9,315,012 | B2 | 4/2016 | Hoffman, Jr. | |
| 9,828,712 | B2 * | 11/2017 | Taylor | D05C 9/04 |
| 9,849,665 | B2 * | 12/2017 | Livingston | B41F 17/005 |
| 2009/0188401 | A1 * | 7/2009 | Anweiler | B01J 39/00 101/147 |
| 2013/0057632 | A1 * | 3/2013 | Moriya | B41J 3/4078 347/104 |
| 2013/0336702 | A1 * | 12/2013 | Yanagishita | B41J 15/16 400/618 |
| 2015/0360460 | A1 * | 12/2015 | Livingston | B41F 15/18 101/126 |

* cited by examiner

PRINTING PALLET FOR ARTICLES OF CLOTHING

CROSS-REFERENCE TO RELATED APPLICATIONS

This application claims priority to U.S. Provisional Patent Application Ser. No. 62/506,686, filed May 16, 2017, the entirety of which is fully incorporated by reference herein.

BACKGROUND

The present disclosure relates to printing pallets that may be used to print graphics on articles of clothing. This provides printing capabilities on two different locations of the article of clothing during the same printing process.

A common problem faced by the printing of graphics on articles of clothing, such as t-shirts, is that the article of clothing typically has to be placed on a printing pallet to print at one location, removed, and replaced on the printing pallet to print at another location. It would be desirable to provide a product that provides a convenient way to print on two different locations of an article of clothing during the same printing step, without having to first remove the article of clothing from the printing pallet.

BRIEF DESCRIPTION

The present disclosure relates to printing pallets that may be used to print graphics at two different locations of the article of clothing during the same printing process. In particular, the two locations are on the front exterior surface of the clothing article and at the top interior surface (i.e. the label area) of the clothing article.

In accordance with one aspect of the present disclosure, pallets for printing on an article of clothing are disclosed. The pallets include (i) a mount plate having a first end and a second end, and (ii) a top plate having a first end and a second end, the second end of the top plate located at the second end of the mount plate. The first end of the top plate is oriented towards the first end of the mount plate, so that the top plate overlays the mount plate. A gap (in height) is located between the top plate and the mount plate. A collar plate is also included which is located on the first end of the mount plate. The first end of the mount plate extends beyond the first end of the top plate to define a space between the top plate and the collar plate (i.e. along the length of the pallet). The top plate is wider than the mount plate.

An upper surface of the top plate and an upper surface of the collar plate are generally coplanar.

In particular embodiments, the pallet includes a stiffener plate located between the second end of the mount plate and the second end of the top plate. The stiffener plate defines the gap between the top plate and the mount plate.

In particular embodiments, the pallet also includes a collar mount located at the first end of the mount plate and the collar plate is located on top of the collar mount.

In some embodiments, the collar plate has a general C-shape when viewed from the side, and the general C-shape is at least partially defined by a first leg and a second leg. The first leg of the collar plate extends beyond the first end of the mount plate. The second leg of the collar plate extends toward the top plate. The collar plate can be adjustable in a forward direction toward the top plate and a backward direction away from the top plate.

In particular embodiments, the mount plate includes a plurality of through holes for attaching the top plate and the collar plate to the mount plate.

In some particular embodiments, the gap has a fixed distance of about 0.125 to 0.50 inches. The mount plate has a length of about 20 to 25 inches and a width of about 5 to 10 inches. The top plate has a length of about 15 to 20 inches and a width of about 10 to 20 inches. The mount plate is always longer than the top plate. The top plate is usually wider than the mount plate.

The entire pallet, including the mount plate, the top plate, and the collar plate, can be made from aluminum.

The article of clothing can be a t-shirt, or a sweat shirt, among others.

Also disclosed herein are methods of printing on an article of clothing using a printing pallet. The method includes receiving a printing pallet having the structure described above and herein. An article of clothing is received for mounting, with the front of the clothing article being placed over the top plate and the rear of the clothing article being placed within the gap, and an inner surface adjacent to a collar of the article of clothing being mounted over the collar plate. Printing is then performed onto both the front outer surface of the article of clothing and the inner surface adjacent to the collar (i.e. the label area).

The article of clothing is positioned over the top plate such that the outer surface of the article of clothing defines a first printing surface. The inner surface adjacent the collar is then positioned over the collar plate such that the inner surface adjacent the collar defines a second printing surface coplanar with the first printing surface. Printing then proceeds on the first printing surface and the second printing surface without needing to remove the article of clothing from the printing pallet.

Also disclosed herein is a pallet for printing on an article of clothing, which includes (i) a mount plate having a first end and a second end, (ii) a stiffener plate attached on the second end of the mount plate, (iii) a top plate having a first end and a second end, wherein the second end of the top plate is attached on top of the stiffener plate, a gap between the top plate and the mount plate having a fixed distance defined by the stiffener plate, (iv) a collar mount attached on the first end of the mount plate, and (v) a collar plate attached on top of the collar mount such that an upper surface of the collar plate is coplanar with an upper surface of the top plate. The first end of the mount plate extends beyond the first end of the top plate to define a space between the top plate and the collar plate.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
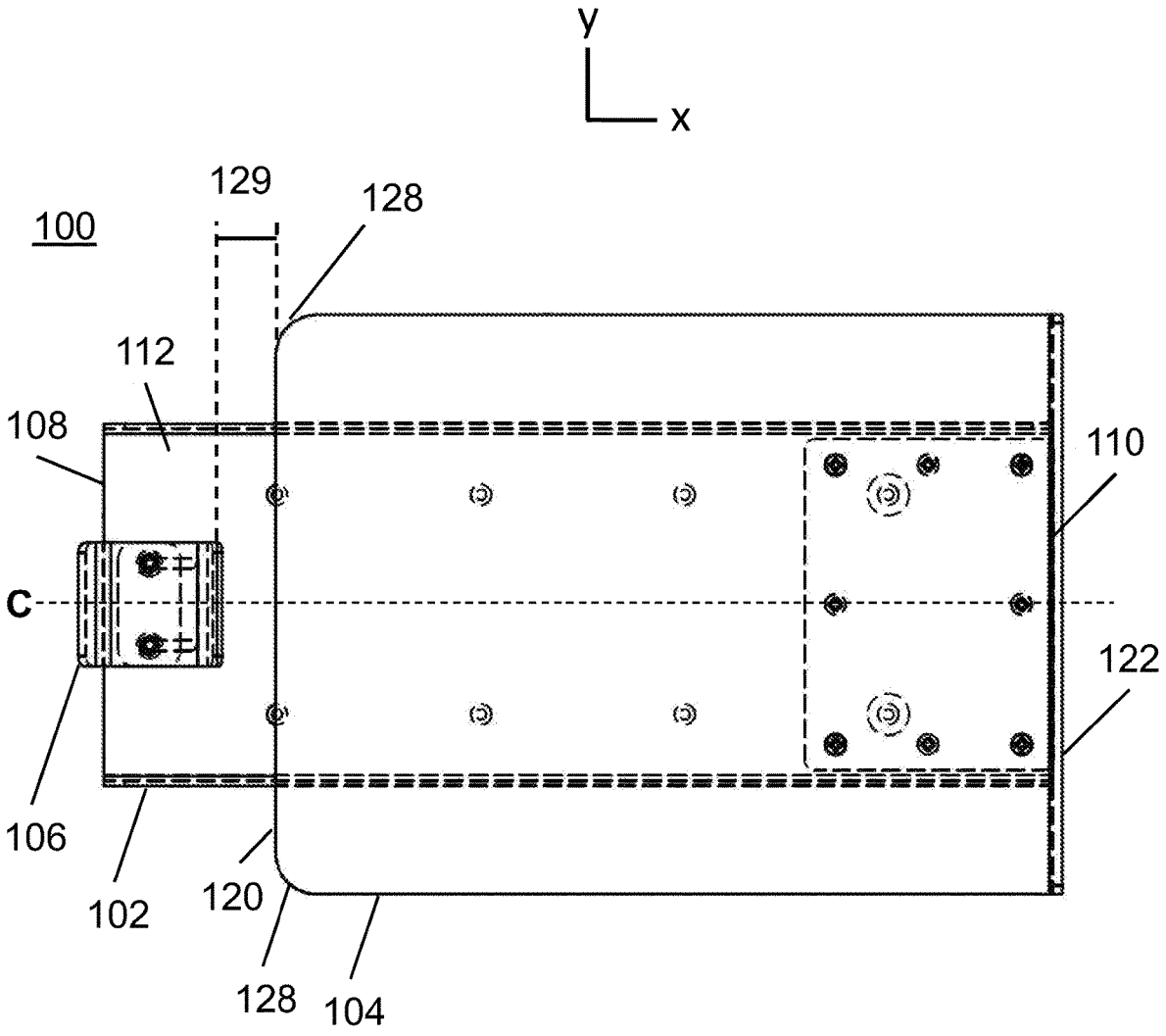
FIG. 1 is a top view of an exemplary embodiment of a printing pallet of the present disclosure.

A more complete understanding of the components and apparatus disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function. The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components. However, such description should be construed as also describing the devices and parts as "consisting of" and "consisting essentially of" the enumerated components, and excluding other components.

Numerical values should be understood to include numerical values which are the same when reduced to the same number of significant figures and numerical values which differ from the stated value by less than the experimental error of the conventional measurement technique used to determine the value.

The phrase "coplanar" is used herein in the lay sense of two surfaces being at about the same height, and should not be construed in a strict mathematical sense.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

Figure 2:
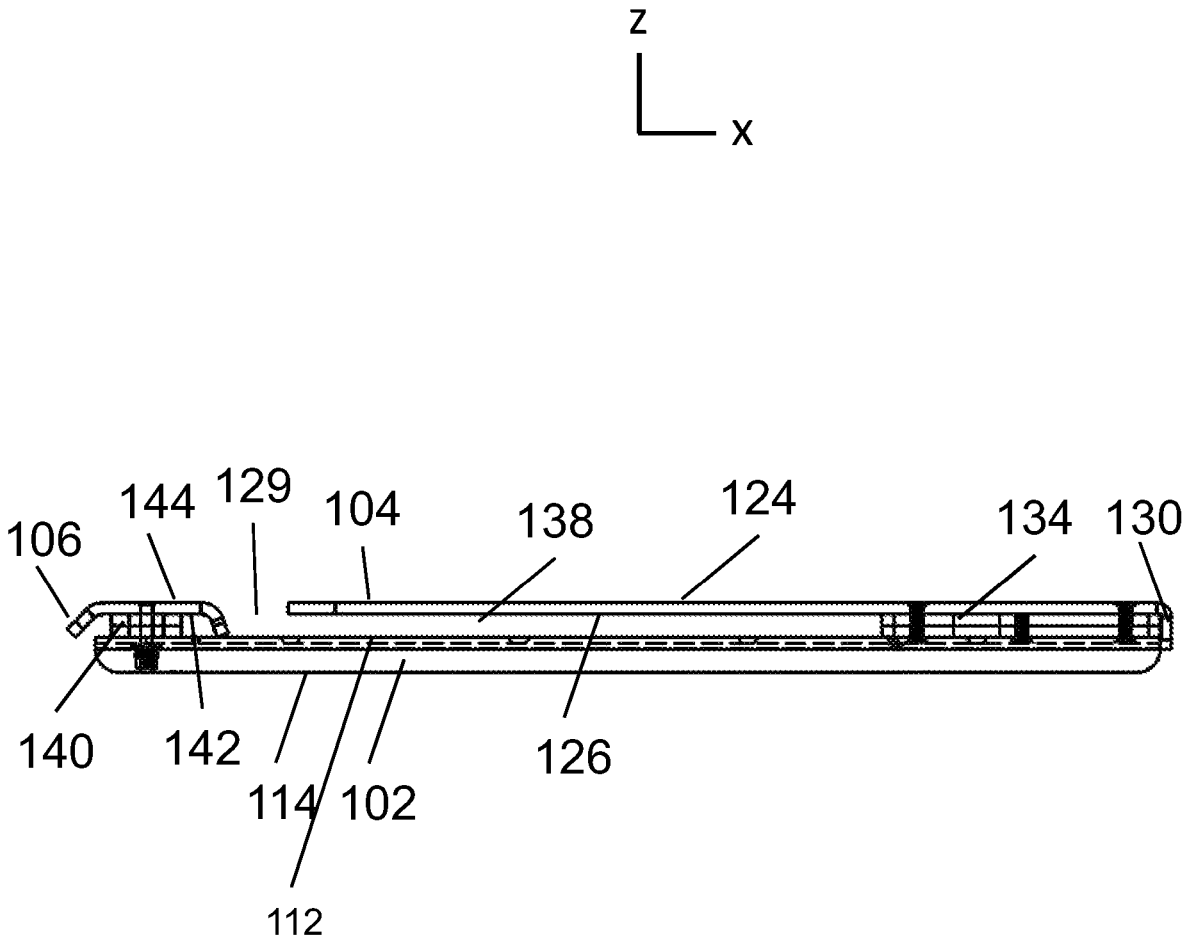
FIG. 2 is a side view of the printing pallet of FIG. 1.
Figure 3A:
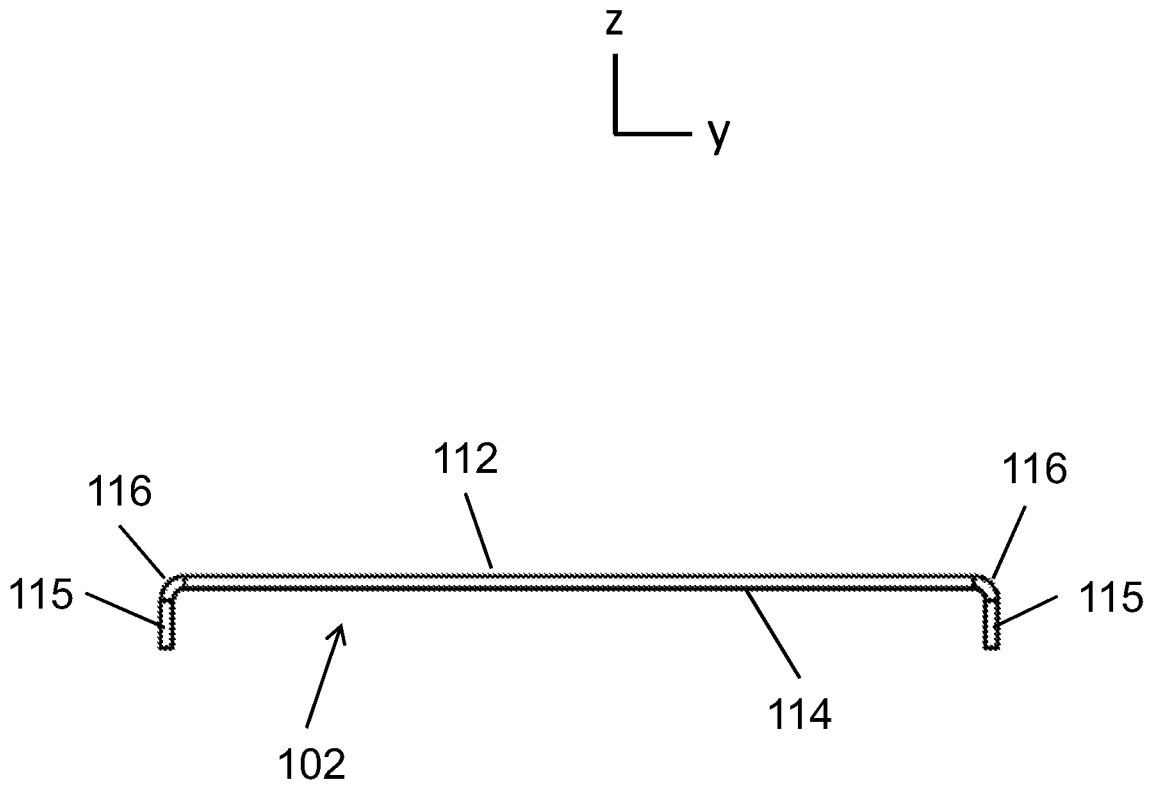
FIG. 3A is a front view of a mount plate for use in the printing pallet of FIGS. 1 and 2.
Figure 3B:
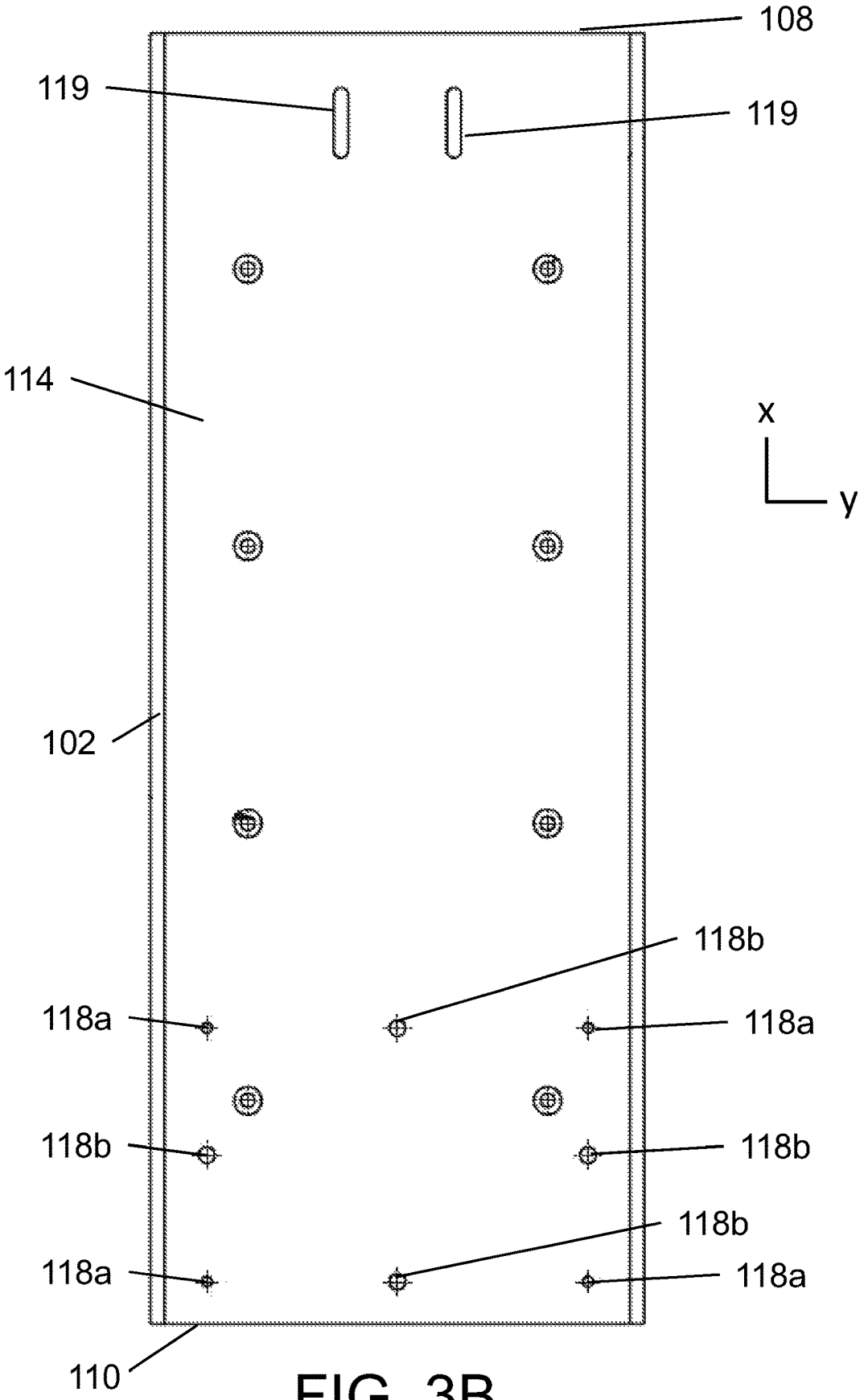
FIG. 3B is a top view of the mount plate of FIG. 3A.
Figure 4A:
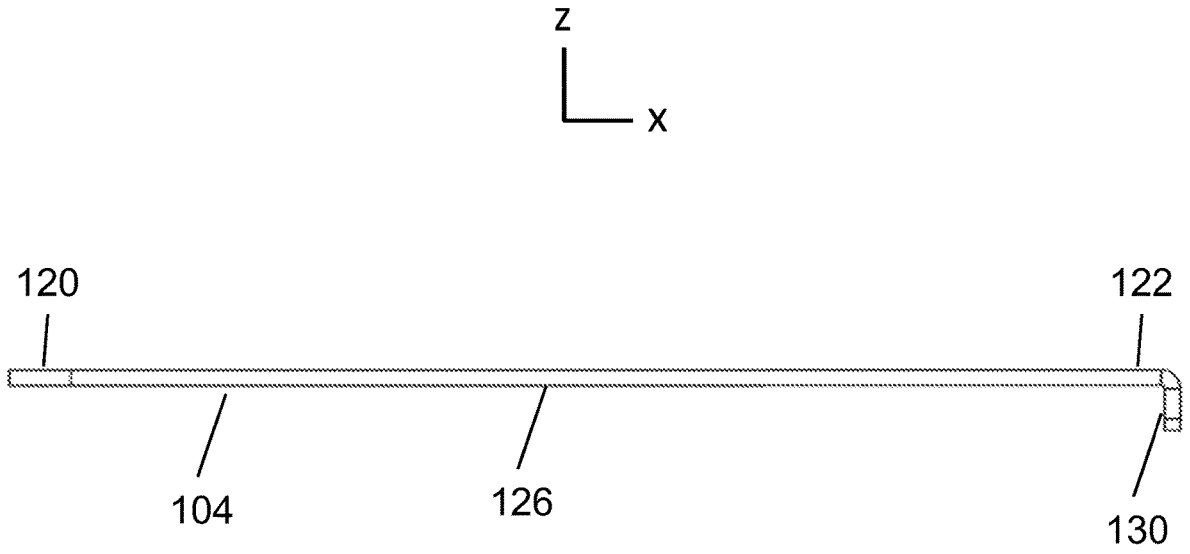
FIG. 4A is a side view of a top plate for use in the printing pallet of FIGS. 1 and 2.
Figure 4B:
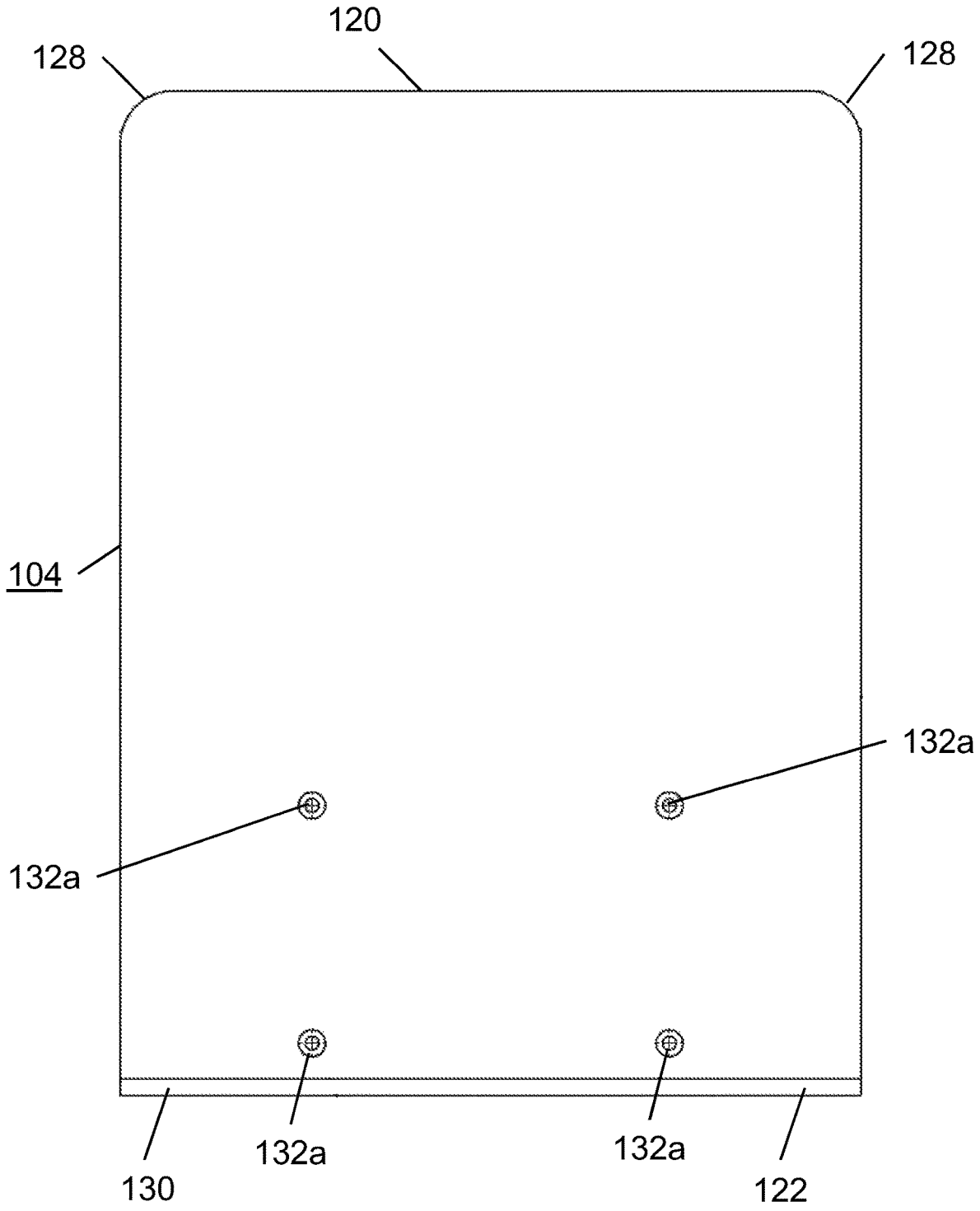
FIG. 4B is a bottom view of the top plate of FIG. 4A.
Figure 5:
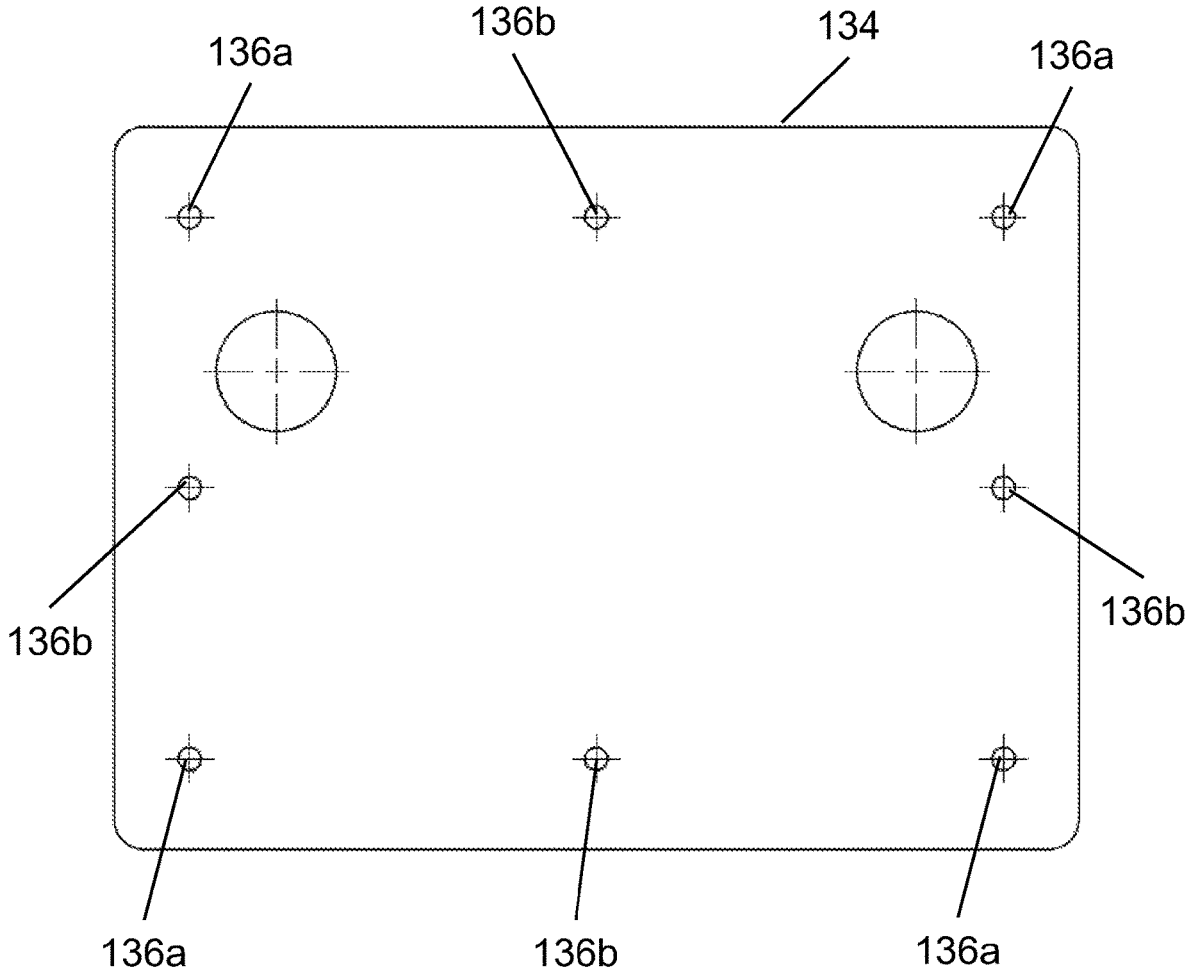
FIG. 5 is a top view of a stiffener plate for use in the printing pallet of FIGS. 1 and 2.
Figure 6:
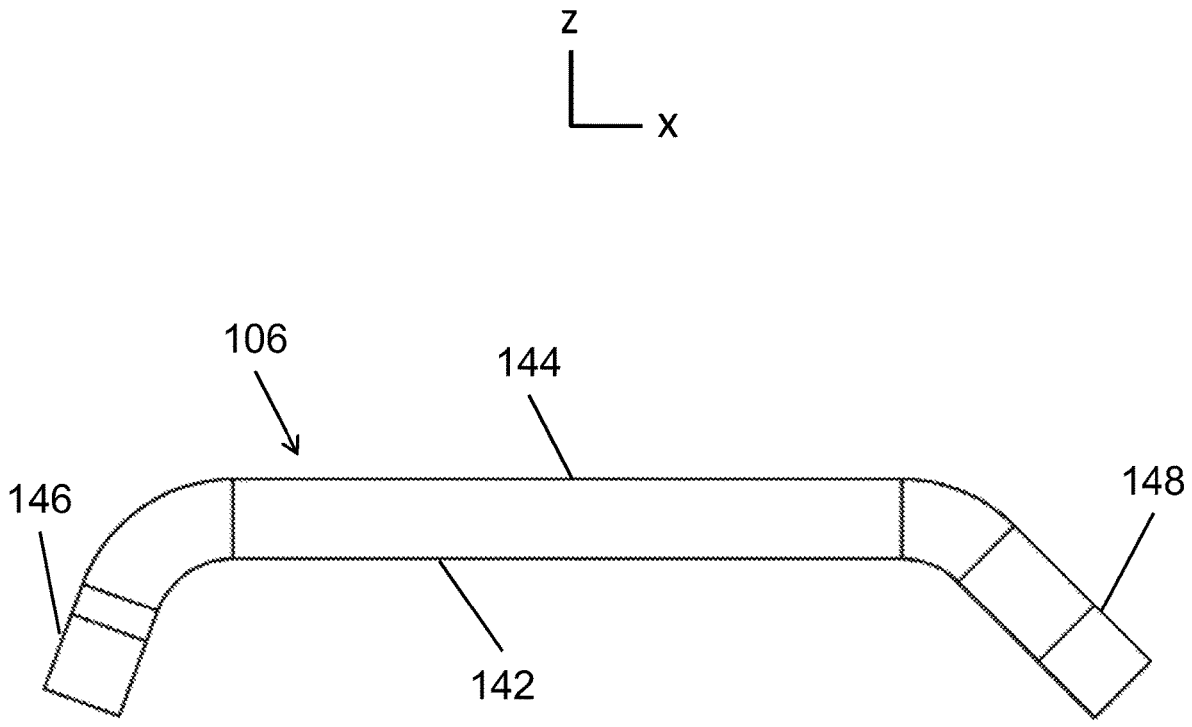
FIG. 6 is a side view of a collar plate for use in the printing pallet of FIGS. 1 and 2.

FIG. 1 and FIG. 2 are two views of an exemplary embodiment of a printing pallet for articles of clothing, such as t-shirts. FIG. 1 is a top view and FIG. 2 is a side view. FIGS. 3-6 are various views of the various components which make up the pallet illustrated in FIGS. 1-2. FIG. 3A and FIG. 3B are a front view and a top view, respectively, of a mount plate discussed in further detail below. FIG. 4A and FIG. 4B are a side view and a bottom view, respectively, of a top plate discussed in further detail below. FIG. 5 is a top view of a stiffener plate discussed in further detail below. FIG. 6 is a side view of a collar plate discussed in further detail below.

Referring first to FIG. 1 and FIG. 2, the printing pallet 100 is generally comprised of three main components including a mount plate 102, a top plate 104, and a collar plate 106. The mount plate 102 has a first end 108 and a second end 110 that define a length of the mount plate. The mount plate also has an upper surface 112 and a lower surface 114. The top plate 104 has a first end 120 and a second end 122 that define a length of the top plate. The top plate also has an upper surface 124 and a lower surface 126. The top plate 104 can include curved corner portions 128 located at the first end 120 of the top plate.

The second end 122 of the top plate 104 is generally located at the second end 110 of the mount plate 102 and on the upper surface 112 thereof. The first end 120 of the top plate is aligned in the direction of the first end 108 of the mount plate. Put another way, the lengths of the mount plate 102 and the top plate 104 generally extend along a common axis (i.e., the X-axis). The length of the mount plate 102 is greater than the length of the top plate 104. In other words, the first end 108 of the mount plate 102 extends beyond the first end 120 of the top plate 104. In addition, the widths of the mount plate 102 and the top plate 104 extend along a common axis (i.e., the Y-axis of FIG. 1). However, the width of the top plate 104 is greater than the width of the mount plate 102.

In some particular embodiments, the mount plate has a length of about 20 inches to about 25 inches, and the top plate has a length of about 15 inches to about 20 inches. In some particular embodiments, the mount plate has a width of about 5 to about 10 inches and the top plate has a width of about 10 inches to about 20 inches. However, these dimensions are only exemplary and it should be understood that the mount plate and top plate can have any desired dimensions necessary to support clothing articles of different sizes. For example, the dimensions of the mount plate and the top plate can be changed to support commonly known t-shirt sizes, such as small, medium, large, x-large, etc. and the like. However, the top plate generally has a shorter length and a greater width compared to the mount plate.

The collar plate 106 is located at the first end 108 of the mount plate 104 and on the upper surface thereof. Because of the difference in length between the mount plate 102 and the top plate 104, a space 129 is defined between the top plate 102 and the collar plate 106 along the length of the pallet (i.e. the X-axis). The mount plate 102, top plate 104, and collar plate 106 are generally located relative to one another such that a common center line C is shared between the mount plate, top plate, and collar plate.

Referring to FIG. 2, a stiffener plate 134 can be located between the upper surface 112 of the mount plate 102 and the lower surface 126 of the top plate 104 at the second ends 110, 122 of the mount plate and top plate, respectively. The stiffener plate defines a vertical gap 138 (i.e. along the Z-axis) having a fixed distance between the upper surface 112 of the mount plate and the lower surface 126 of the top plate 104. In some particular embodiments, the fixed distance of the gap 138 (i.e., the thickness of the stiffener plate 134) can be about 0.125 inches to about 0.50 inches, including about 0.25 inches. A collar mount 140 can be located at the first end 108 of the mount plate 102, between the upper surface 112 of the mount plate and a lower surface 142 of the collar plate 106. These components are sized such that the upper surface 144 of the collar plate is coplanar with the upper surface 124 of the top plate 104. Put another way, the upper surface 144 of the collar plate is raised above the upper surface 112 of the mount plate. There are no other surfaces at the first end 108 of the mount plate that are raised above the upper surface 112 of the mount plate.

Additional details of the mount plate 102 are shown in FIG. 3A and FIG. 3B. Starting with FIG. 3A, the mount plate 102 has two legs 115 which run the length of the mount plate and which generally extend downward from the lower surface 114 of the mount plate. A curved edge 116 provides a transition between the legs 115 and the upper surface 112 of the mount plate 102.

Referring to FIG. 3B, the mount plate 102 can be provided with a plurality of through holes 118*a*, 118*b* at the second end 110 of the mount plate. These through holes generally extend through the thickness of the mount plate, or in other words between the lower surface 114 and the upper surface 112. The plurality of through holes 118*a*, 118*b* provide a means for attaching the top plate 102 to the mount plate 102 using associated fasteners (not shown) known to those having skill in the art, such as bolts, nuts, screws, rivets, etc., as will be explained further herein.

As also seen in FIG. 3B, the mount plate 102 includes one or more attachment slots 119 at the first end 108 of the mount plate. These attachment slots also extend through the thickness of the mount plate, or in other words between the lower surface 114 and the upper surface 112. The one or more attachment slots 119 provide a means for attaching the collar mount 140 and collar plate 106 using associated fasteners (not shown) to the first end 108 of the mount plate 102 on the upper surface 112 thereof. In this regard, the collar mount 140 and collar plate 106 include corresponding attachment holes (not shown). When the mount plate 102, the collar mount 140, and the collar plate 106 are assembled, the attachment holes of the collar mount and the collar plate are aligned with the attachment slots 119 of the mount plate 102 to receive the associated fasteners. Suitable associated fasteners for use with the attachment slots 119 and the attachment holes of the collar mount 140 and collar plate 106 are as described above. The attachment slots are designed so that the collar mount 140 and the collar plate 106 can be adjusted back and forth along the attachment slots 119 to a desired position relative to the top plate (which is fixed in place relative to the mount plate). Once the collar mount 140 and collar plate 106 are in the desired position, the fasteners can easily be re-tightened to secure the collar mount to the mount plate 102. In other words, the space 129 between the collar plate 106 and the top plate 104 can be increased or decreased as desired.

Referring now to FIG. 4A, additional details of the top plate 104 are shown. In particular, the top plate 104 can include a leg portion 130 located at the second end 122 of the top plate. The leg portion 130 generally extends in a downward direction from the lower surface 126 of the top plate 104. When fully assembled with the stiffener plate 134 and the mount plate 102, the leg portion 130 is generally located behind the stiffener plate, as seen in FIG. 2. The leg portion is intended to aid in assembling the pallet, however it should be noted that the leg portion 130 is optional.

FIG. 4B is a top view of the top plate 104. The curved corner portions 128 are visible at the first end 120 of the top plate. The leg portion 130 is indicated at the opposite end of the top plate. Through holes 132*a* are also present at the second end 122. These through holes 132*a* align with the through holes 118*a* of the mount plate seen in FIG. 3B (note the scale of these two figures is somewhat different).

FIG. 5 is a top view of the stiffener plate 134 that can be used to create the gap between the mount plate and the top plate. The stiffener plate has a first set of through holes 136*a*, and a second set of through holes 136*b*, all located about the perimeter of the stiffener plate. The through holes 136*a* align with the through holes 118*a* of the mount plate seen in FIG. 3B. The through holes 136*b* align with the through holes 118*b* of the mount plate seen in FIG. 3B.

Referring now to FIG. 3B, FIG. 4B, and FIG. 5 together, through holes 118*a* are used to attach both the stiffener plate 134 and the top plate 104 to the second end 110 of the mount plate 102. Generally, through holes 118*b* and 136*b* are concentrically aligned first, and are used to attach only the stiffener plate 134 to the mount plate 102. Through holes 118*a*, 132*a*, and 136*a* are then concentrically aligned to receive fasteners to join the mount plate 102, the stiffener plate 134, and the top plate 104 together. The presence of the through holes 118*b*, 136*b* is intended to make it easier to assemble the pallet together by first permitting two of the plates to be securely joined together, then joining the top plate to the other two plates. However, the through holes 118*b*, 136*b* can be optional as well.

Additional details of the collar plate 106 can be seen in FIG. 6. In particular, the collar plate 106 is shown as being a generally C-shaped body when viewed from the side. The C-shape of the collar plate 106 is at least partially defined by a first leg 146 and a second leg 148 which extend downwards from the lower surface 142. When fully assembled with the mount plate 102 and/or the collar mount 140, the first leg 146 of the collar plate 106 extends beyond the first end 108 of the mount plate and the second leg 148 extends toward the first end 120 of the top plate (see FIG. 1).

The pallet 100 and its associated components, including the mount plate 102, top plate 104, collar plate 106, stiffener plate 134, and collar mount 140 can be made from any material known to those having skill in the art as being useful in the production of printing pallets. Such materials include metals, wood, plastic, etc. However it is preferred that the pallet and its associated components are made from aluminum.

Referring back to FIG. 1 and FIG. 2, the collar plate 106 is raised (along the Z-axis) relative to the mount plate 102. It is noted that there is no ring around the collar plate, or any other structure that interacts with the collar plate so as to create any slot around the collar plate.

The pallet 100 and its associated components described above are useful in the printing of graphics (e.g., text, images, etc.) onto articles of clothing, such as t-shirts, sweatshirts, sweaters, long-sleeve shirts, polo shirts, jackets, coats, blouses, etc., and any other article of clothing which is generally worn on the upper part of the body.

Figure 7:
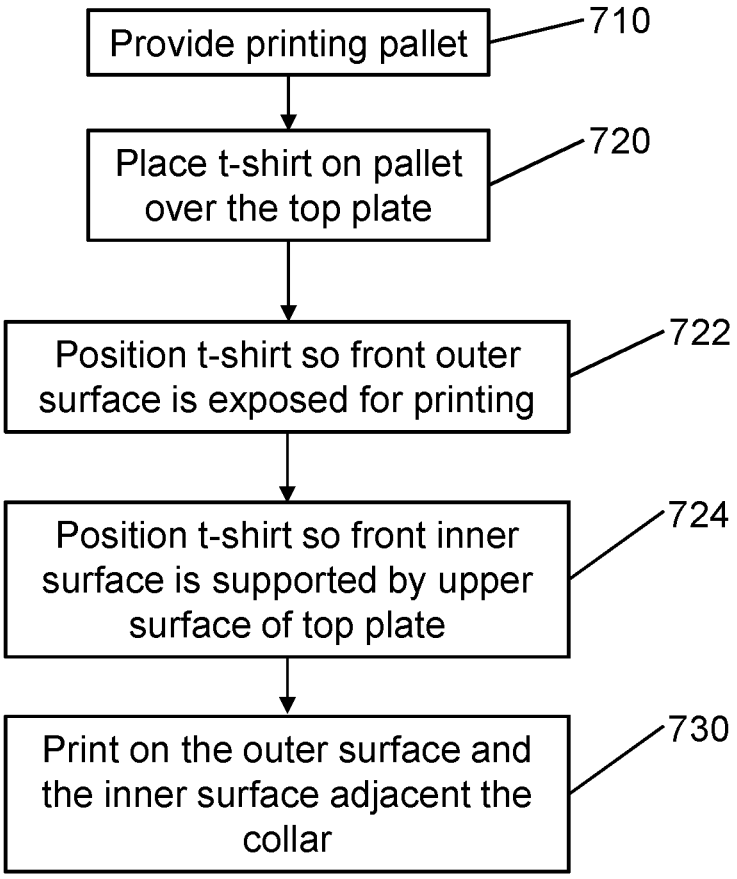
FIG. 7 is a flowchart illustrating the methods of the present disclosure.
Figure 8:
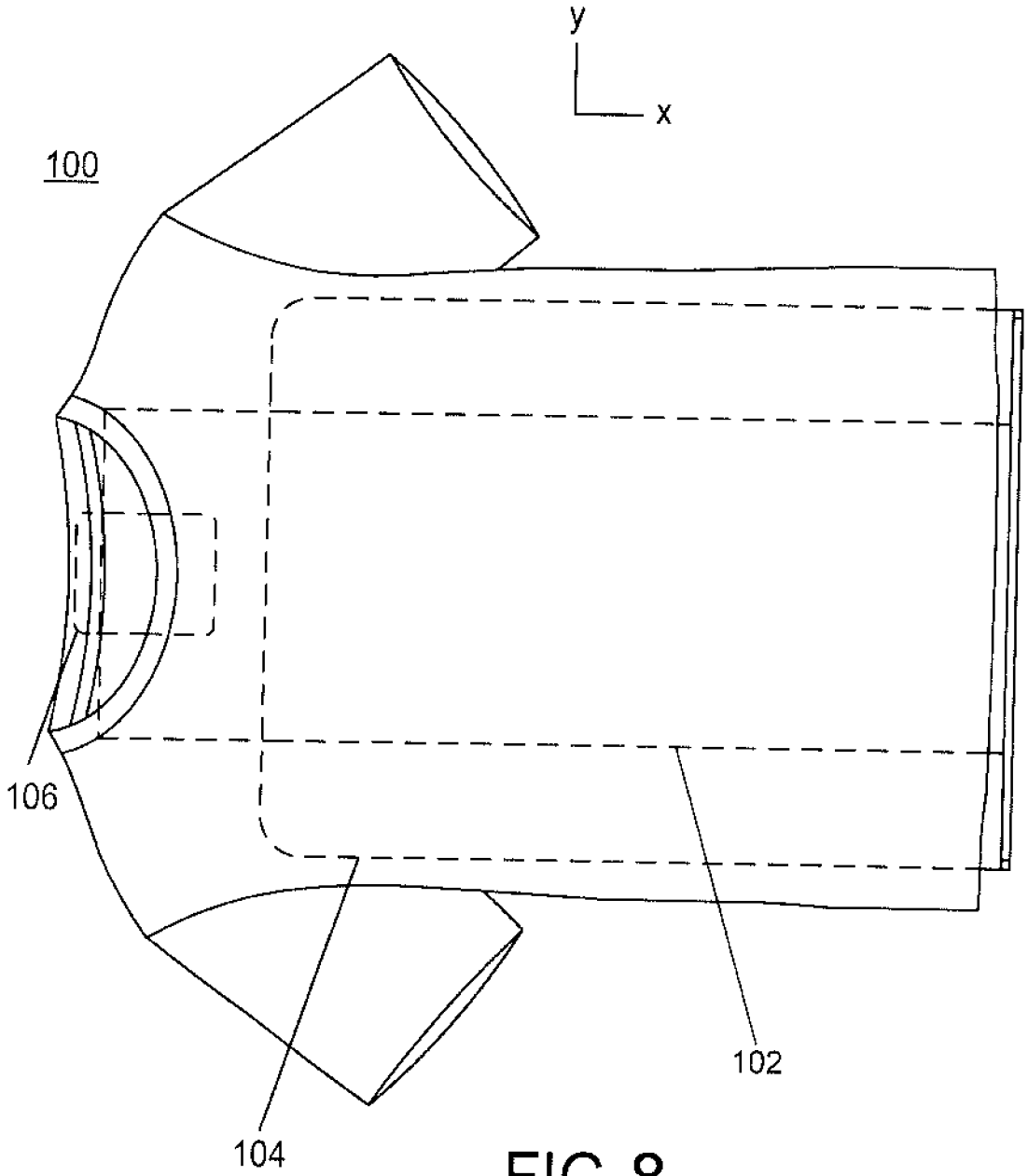
FIG. 8 is an illustration showing an article of clothing mounted upon the printing pallet.

Referring to FIG. 7 and FIG. 8, use of the pallet 100 can be described with reference to a t-shirt. FIG. 7 is a flowchart illustrating the methods of the present disclosure. In step 710, the pallet is provided. The t-shirt is received for mounting upon the pallet 100. The t-shirt itself will have a front and a back. The front of the t-shirt will have an outer surface, while the back of the t-shirt will have both an outer surface and an inner surface. The upper end of the t-shirt will have a collar, which is shaped such that a portion of the inner surface of the back of the t-shirt will be visible from the front. This portion of the inner surface of the back of the t-shirt can be referred to herein as the "label area", and is the location where a label is usually placed on the t-shirt. The label can be used to identify the maker of the t-shirt, provide information on the washing/drying of the t-shirt, etc.

In step 720 of FIG. 7, the t-shirt is placed on the pallet over the top plate 104, such that the outer surface of the front of the t-shirt is upon the top plate 104, while the back of the t-shirt is located within the gap 138 and through the space 129. The article of clothing is first received at the space 129 defined between the top plate 104 and the collar plate 106, and the back side of the article of clothing is located within the gap 138. This is illustrated in FIG. 8. The top plate 104 is positioned within the t-shirt such that a front inner surface of the t-shirt is supported by the upper surface 124 of the top plate 104 (step 724), and a front outer surface (e.g., a chest portion) is exposed for printing (step 722). The curved corners 128 of the top plate 104 help to prevent the t-shirt from getting caught/ripped as an operator slides the t-shirt down the pallet.

Prior to or after positioning the front outer surface of the t-shirt on the top plate 104, the inner surface adjacent to the collar of the t-shirt is placed on the collar plate 106. The collar is placed around the collar plate 106 and the inner surface adjacent the collar (i.e. the label area) is mounted over the upper surface 142 of the collar plate. The C-shape of the collar plate 106 facilitates the placing of the collar around the collar plate. The first leg 146 of the collar plate 106 can be used to "hook" a portion of the collar so that the inner surface adjacent the collar is held in place on the collar plate. The inner surface adjacent the collar defines a second printing surface. Since the upper surface 142 of the collar plate 106 is coplanar with the upper surface 124 of the top plate 104, as described above, the first printing surface defined by the front side outer surface of the t-shirt is also coplanar with the second printing surface defined by the inner surface adjacent the collar. In this regard, when printing proceeds in step 730 of FIG. 7, printing occurs on the first printing surface and the second printing surface without having to remove the t-shirt from the pallet. In other words, both the front outer surface and the inner surface adjacent the collar of the t-shirt can be printed during the same printing step.

The second printing surface defined by the inner surface adjacent the collar of the t-shirt typically provides a smaller printing area relative to the first printing surface defined by the front outer surface of the t-shirt, which provides a larger printing area. For example, a smaller logo type graphic can be printed on the inner surface adjacent the collar, while a larger logo or different graphic design can be printed on the front outer surface of the t-shirt.

The printing pallets disclosed herein can be used for any suitable printing process. For example, printing processes such as screen printing, direct to garment, transfer printing, heat press transfer printing, heat transfer vinyl printing, etc., and the like, can be used.

The present disclosure has been described with reference to an exemplary embodiment. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A method of printing on an article of clothing using a pallet, comprising:

(A) providing a pallet including:

a mount plate including a first end and a second end, a top plate including a first end and a second end, the second end of the top plate being located at the second end of the mount plate and the top plate being fixed in place relative to the mount plate, a gap between the top plate and the mount plate, a collar plate located on the first end of the mount plate, and wherein the first end of the mount plate extends beyond the first end of the top plate to define a space between the top plate and the collar plate, and wherein the collar plate is adjustable in a forward direction toward the top plate and a backward direction away from the top plate;

(B) receiving an article of clothing for mounting over the top plate and within the gap, and receiving an inner surface adjacent to a collar of the article of clothing such that the collar is placed around the collar plate and the inner surface is mounted over the collar plate; and (C) printing onto both an outer surface of the article of clothing and the inner surface adjacent to the collar.

2. The method of claim 1, further comprising positioning the article of clothing over the top plate such that the outer surface of the article of clothing defines a first printing surface.

3. The method of claim 2, wherein printing proceeds on the first printing surface and the second printing surface without removing the article of clothing.

4. The method of claim 1, further comprising positioning the inner surface adjacent the collar over the collar plate such that the inner surface adjacent the collar defines a second printing surface coplanar with the first printing surface.

5. The method of claim 1, wherein the top plate is wider than the mount plate.

6. The method of claim 1, further comprising a stiffener plate located between the second end of the mount plate and the second end of the top plate, the stiffener plate defining the gap between the top plate and the mount plate.

7. The method of claim 1, further comprising a collar mount located at the first end of the mount plate, wherein the collar plate is located on top of the collar mount.

8. The method of claim 1, wherein an upper surface of the top plate and an upper surface of the collar plate are generally coplanar.

9. The method of claim 1, wherein the collar plate has a general C-shape when viewed from the side, the general C-shape at least partially defined by a first leg and a second leg.

10. The method of claim 9, wherein the first leg of the collar plate extends beyond the first end of the mount plate.

11. The method of claim 10, wherein the second leg of the collar plate extends toward the top plate.

12. The method of claim 1, wherein the mount plate further comprises a plurality of through holes for attaching the top plate and the collar plate to the mount plate.

13. The method of claim 1, wherein the gap has a fixed distance of about 0.125 to 0.50 inches.

14. The method of claim 1, wherein the mount plate has a length of about 20 to 25 inches and a width of about 5 to 10 inches.

15. The method of claim 1, wherein the top plate has a length of about 15 to 20 inches and a width of about 10 to 20 inches.

16. The method of claim 1, wherein the mount plate, the top plate, and the collar plate are made from aluminum.

17. The method of claim 1, wherein the article of clothing is a t-shirt.

* * * * *